US006119496A

United States Patent [19]

Theriault

[11] Patent Number: 6,119,496

[45] Date of Patent: Sep. 19, 2000

[54] KEYS FOR HIGH SECURITY CYLINDER LOCK SYSTEMS

[75] Inventor: Kenneth T. Theriault, Meriden, Conn.

[73] Assignee: International Security Products, Inc., Southington, Conn.

[21] Appl. No.: 09/167,680

[22] Filed: Oct. 7, 1998

[51] Int. Cl.[7] ..... E05B 19/04

[52] U.S. Cl. ..... 70/406; 70/389; 70/390; 70/419

[58] Field of Search ..... 70/326, 358, 389, 70/390, 375, 406–409, 419, 420, 495, 492

[56] References Cited

U.S. PATENT DOCUMENTS

| | | | |
|---|---|---|---|
| 375,540 | 12/1887 | Donahue | 70/407 |
| 1,403,472 | 1/1922 | Horak | 70/407 |
| 2,151,245 | 3/1939 | Swilens . | |
| 3,742,744 | 7/1973 | Lumme | 70/358 |
| 4,325,242 | 4/1982 | Tietz | 70/401 |
| 4,608,842 | 9/1986 | Tietz | 70/358 |
| 4,612,787 | 9/1986 | Prunbauer et al. | 70/358 |
| 4,869,085 | 9/1989 | Meissner | 70/409 |
| 5,617,750 | 4/1997 | Preddy | 70/419 |
| 5,819,567 | 10/1998 | Eden, Jr. | 70/390 |

*Primary Examiner*—Teri Pham
*Attorney, Agent, or Firm*—Alix, Yale & Ristas, LLP

[57] ABSTRACT

A blank for use in fabricating a key for a cylinder lock having a camming projection extending outwardly from a first side of the blade portion of the blank and a recess in the opposite side of the blade portion. The projection and recess are simultaneously formed in a punching operation and have at least one different geometrical parameter whereby the camming projection is not complementary to the recess and/or has a different orientation than the recess.

14 Claims, 4 Drawing Sheets

KEYS FOR HIGH SECURITY CYLINDER LOCK SYSTEMS

BACKGROUND OF THE INVENTION (1) Field of the Invention

The present invention is directed to improvements in cylinder lock systems and, particularly, to cylinder lock systems characterized by having a large number of possible key combinations and by being difficult to defeat. More specifically, this invention is directed to novel keys which cooperate with cylinder locks to define lock systems which provide highly secure access control. Accordingly, the general objects of the present invention are to provide novel and improved apparatus and articles of said character.

(2) Description of the Prior Art

Mechanical locks which employ one or more pin tumbler arrays are well known in the art. In such prior locks, the tumbler pins are arranged in "stacks" which are displaceable, typically in the radial direction with respect to the axis of rotation of a rotatable core or plug, in response to insertion of a key in a keyway provided in the core. The pin tumbler stacks comprise at least an upper or driver pin and an abutting, axially aligned, driven or bottom pin. These pins are disposed in pin chambers provided in both the rotatable core and the surrounding immobilized shell of the lock. The pin tumbler stacks are resiliently biased in the direction of the core and, with the lock in the locked condition without a proper key in the keyway, one pin of each stack bridges the gap between the core and shell thus preventing relative rotation therebetween. As a result of communication between the keyway and the pin chambers in the core which receive the bottom pins of the pin tumbler stacks, insertion of a properly bitted key in the keyway will result in pin tumbler stack displacement which typically places the interface between the driver and bottom pins at a shear line defined by the core outer circumference. Thus, a properly bitted key will permit the core, with the bottom pins, to rotate within the shell while the driver pins remain stationary. Core rotation will, through the action of a cam or tailpiece mechanically coupled thereto, activate a locking mechanism or latch.

Locks of the type generally described above are known in the art as "cylinder" locks. The most common manner of defeating a cylinder lock consists of "manufacture" of an unauthorized key. It is not possible to ensure against the defeat of a cylinder lock by providing such a lock with a keyway having a complex profile, i.e., a very intricate cross-section, and/or through the use of various arrangements of pin tumbler stacks. The foregoing inability is, in part, a function of the fact that various manufacturers will provide, for locks which achieve a significant sales volume, key blanks having blades which, either as manufactured or as shaped using conventional key-cutting machines, have a profile which enables their use, after being "cut", with such locks. Thus, there has been a long standing desire for a lock system which affords increased security through minimizing the possibility of unauthorized manufacture of replacement key blanks and, particularly, for a lock system which affords the lock manufacturer the ability to exercise key control by being the sole source of the key portion of the system.

The requirements summarized in the immediately preceding discussion have been met by the lock systems and associated keys described in U.S. Pat. Nos. 5,819,567 and 5,823,030 both of which are assigned to the assignee of the present invention. The disclosures of the aforemetioned patents are incorporated herein by reference.

In the lock system of U.S. Pat. No. 5,819,567, the core of the cylinder lock includes, at the position of at least one pin tumbler stack, a cut-out which is generally in the shape of a circular segment. With the lock in the locked state, i.e., prior to rotation of the core relative to the shell, this circular segment will be out of alignment with the associated pin tumbler stack. The cut-out communicates with the keyway via an opening provided in a side of the keyway. A plate member or segment is inserted in the cut-out, the plate member being sized and shaped so as to be capable of limited movement within the cut-out and relative to the core. The plate member includes a projection which extends into the keyway and functions as a cam follower. Movement of the plate member relative to the core may be produced by a camming projection, provided on the side of an authorized key, which contacts the cam follower projection when the key blade is inserted in the keyway. The camming projection on the key blade extends outwardly beyond the plane of the side of the blank from which the key was formed. The plate member, when caused to move along a path defined by the shell internal diameter in response to force delivered thereto by the camming projection on the authorized key, will function as an extension of the core and will present a surface which generally corresponds to the shear line defined by the outer diameter of the core. Thus, with an authorized key in the keyway, the core will appear to be uninterrupted to the driver pin of the pin tumbler stack at the location of the cut-out. However, in the case of an unauthorized key which lacks a proper camming projection, core rotation will result in the plate member being displaced below the shear line so as to, in part, define an opening into which the driver pin will move once the core has been rotated relative to the shell sufficiently to fully register the pin tumbler chamber in the shell with the cut-out in the core. The driver pin will, accordingly, move inwardly toward the core so as to bridge the shear line and prevent further core rotation in either the clockwise or counterclockwise direction. The lock will thus be rendered inoperable and the unauthorized key will be trapped in the keyway. When compared to a prior art lock system which lacks the camming projection on the key and the cooperating segment shaped plate with integral cam follower, the lock of U.S. Pat. No. 5,819,567 substantially increases the number of possible combinations since a circular segment cut-out can be located at any one of, or at a plurality of, the locations along the length of the keyway which are defined by the pin tumblers. The number of possible combinations is additionally increased by the ability to change the size and shape of the cooperating cam follower and key blade camming projection.

Both the degree of security afforded by and the number of possible combinations of the lock system of U.S. Pat. No. 5,819,567 can be further increased by the invention of U.S. Pat. No. 5,823,030. The invention of U.S. Pat. No. 5,823,030 includes, as part of the biting, a specially shaped recess in the side of the key blade which is disposed oppositely with respect to the side from which the camming projection extends. With the key inserted in the keyway, this recess is in registration with a chamber in the core which receives an auxiliary locking pin. This chamber, most expediently, is oriented such that its axis is transverse to a plane defined by the side of the blank from which the key was formed. The auxiliary locking pin is resiliently biased outwardly by a spring whereby a first end thereof engages a cooperating recess in the inner diameter of the shell, i.e., the auxiliary locking pin bridges the shear line with the lock in the locked state. The outwardly disposed first end of the auxiliary locking pin and the side wall of the cooperating recess in the shell are cooperatively shaped such that relative rotation between the core and shell will, if movement of the auxiliary locking pin toward the keyway against its spring bias is possible, cam the auxiliary locking pin out of the recess in the shell. Once the auxiliary locking pin is released from engagement with the shell, the outwardly disposed first end thereof slides on the internal diameter of the shell during further core rotation. The release of the auxiliary locking pin from its engagement with the shell, however, can occur only when a key blade having a recess sized, shaped and located to receive the second end of the auxiliary locking pin is present in the facing side of a key blade inserted in the keyway. Thus, in the invention of U.S. Pat. No. 5,823,030, an authorized key must, in addition to the conventional or prior art biting and a correct profile, have both at least a first uniquely shaped and positioned camming projection on a side of the blade and at least a first properly positioned and shaped locking pin receiving recess on a side of the blade.

SUMMARY OF THE INVENTION

The present invention comprises an improvement to the lock systems and keys of above-referenced U.S. Pat. Nos. 5,189,567 and 5,823,030. The present invention, accordingly, further increases the utility of the inventions of the prior applications.

In accordance with a preferred embodiment of the present invention, the camming projection on the key blade extends outwardly from a surface which is angularly inclined relative to the plane of the side face of the blade of the key blank, the plane being defined before the key blank is subjected to profile milling. The camming projection also extends outwardly beyond this plane.

Also in accordance with the present invention, the camming projection on the key blade is formed by displacing material which comprises the blade. Thus, the projection and a recess on the opposite side of the blade are simultaneously formed. However, the projection and recess desirably have geometric features which are dissimilar. Thus, the projection and recess may not be complementary in size and/or shape. Also, the camming projection and recess may not be axially aligned. Further, the camming projection and/or the recess may not be symmetrical with respect to an axis and/or separate axes.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE ENCLOSED EMBODIMENTS

In the typical cylinder lock construction, the pin tumblers are arranged in a linear array and the axes of the pin tumblers thus define a plane which extends through the center of the keyway. This plane is thus also parallel to planes defined by the most widely separated side surfaces of the keyway. While not limited thereto in its utility, the present invention is particularly well suited for incorporation in a cylinder lock having a keyway with a cross-section which includes a "shelf", i.e., a warding, which extends at an angle of other than 90° with respect to the center plane of the keyway. Such angled surface at least in part, will also typically be substantially flat or nearly so. The keyway will, of course, customarily be formed by broaching.

A key for cooperation with a lock as generally described above will have a blade which, in cross-section, is generally complementary in shape to the keyway profile. Thus, the key blade may be provided with a surface which, at least in part, is substantially flat and which is disposed at an angle with respect to the parallel planes defined by the sides of the blade of the key blank before the blank is milled to produce the requisite keyway complementary profile. The flat, angled key blade surface is customarily formed during the milling of the blade of a flat sided key blank, i.e., a key blank formed from flat sheet metal stock, to define the key cross-section, i.e., the profile.

Figure 1:
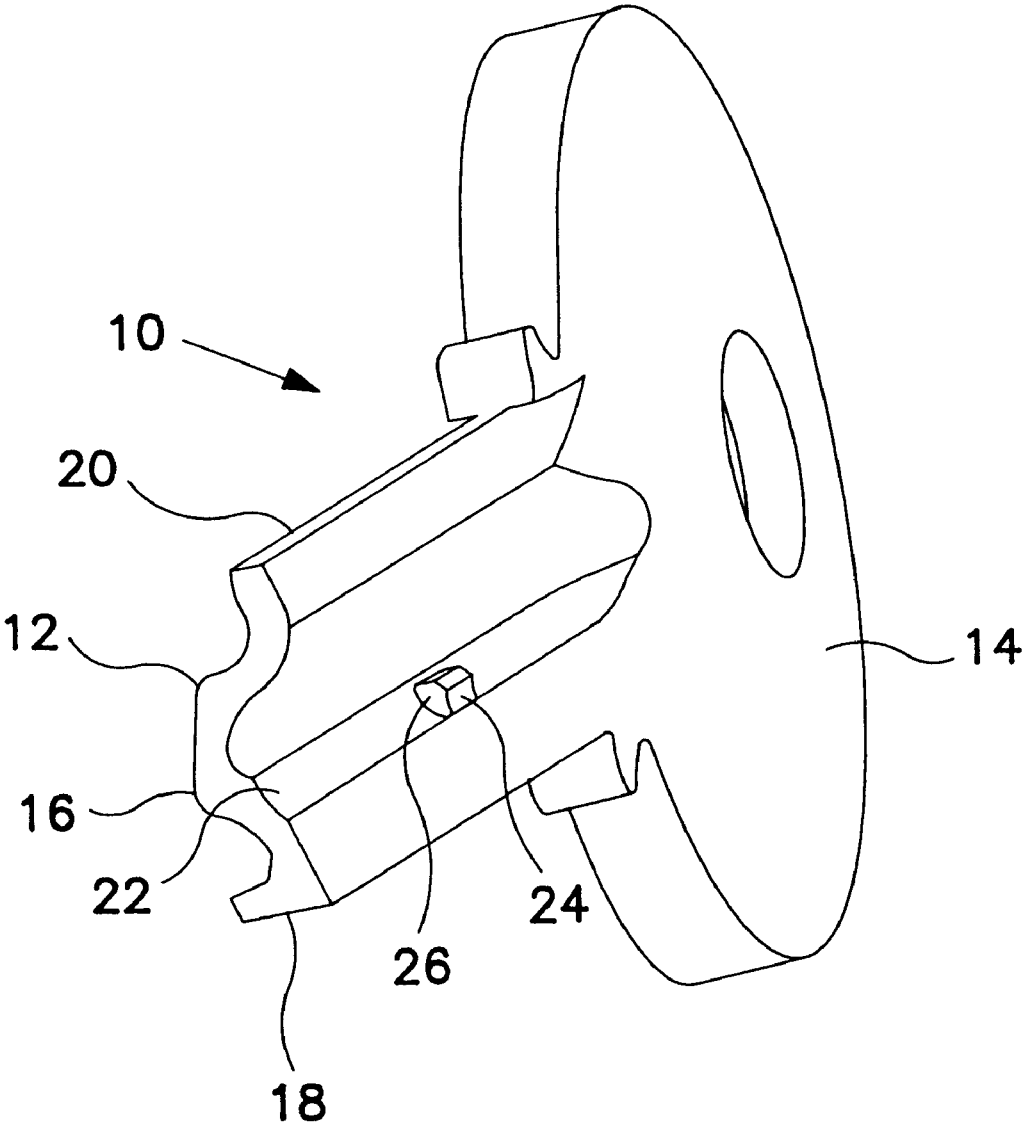
FIG. 1 is a perspective view of a key blank in accordance with the present invention.

With reference to FIG. 1, a key blank in accordance with the present invention is indicated generally at 10. Key blank 10 will typically be comprised of a steel or copper alloy and will include a blade 12 which extends longitudinally from a bow 14 to the blade tip 16. The cross-sectional shape of blade 12 will be determined by the wardings which define the keyway with which the key is to be used. The key cross-section or profile thus includes, intermediate the bottom and top edges 18 and 20 of blade 12 of the embodiment being described, a substantially flat shelf 22 which extends at an angle relative to the plane of the side of blank 10.

In accordance with the present invention, a camming projection 24 will, in the manner to be described below, be provided on shelf 22. Camming projection 24 will, at least in part, extend outwardly beyond the plane defined by the side face of blade 12 prior to the milling of the blade to define the key cross-section. Camming projection 24, at the side thereof which faces blade tip 16, defines a ramp or cam surface 26. Restated, the projection 24 will smoothly increase in height from shelf 22 at least in the direction of bow 14, until it reaches its maximum height.

Referring jointly to all of the figures, in accordance with the invention, the camming projection 24 is produced by a punching operation during which the key blank is positioned against a backup die. Thus, the backup die will contain a cavity sized and shaped to define precisely the desired size, shape and orientation of the camming projection. The camming projection 24 is thus formed by employing a punch which operates on the key blank from the opposite side with respect to that which is positioned against the backup die. The punching force causes material comprising the key blank to flow into the backup die cavity. The punch thus produces, in the side of the key blank disposed oppositely with respect to camming projection 24, a blind hole or recess such as indicated at 30 in FIGS. 2A and 2B. The size, shape and orientation of recess 30 is determined by the size, shape and direction of operation of the punch. A particularly unique aspect of the present invention is that the recess 30 will not have a size and shape which is complementary to that of camming projection 24 and/or the recess 30 and camming projection 24 will not be precisely in registration with one another and/or the direction of motion of the punch will not be transverse to the most outwardly disposed surface of the camming projection 24, i.e., the axes of the projection 24 and the recess 30 will not be parallel but, rather, will have a preselected angular relationship.

Figure 2B:
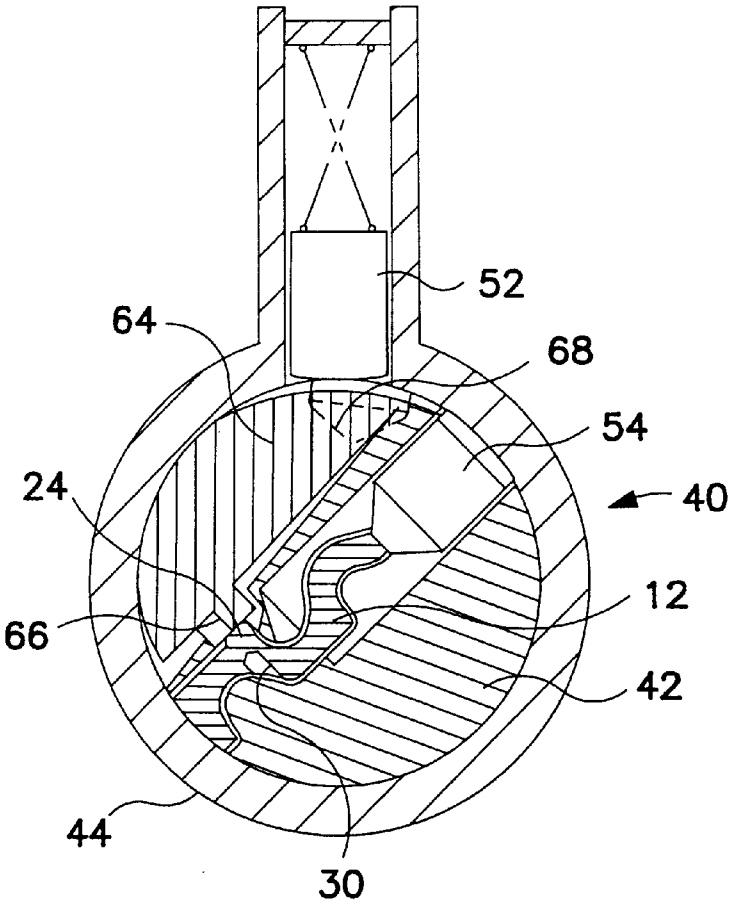
FIG. 2B is a view similar to FIG. 2A but with the core partly rotated.
Figure 2A:
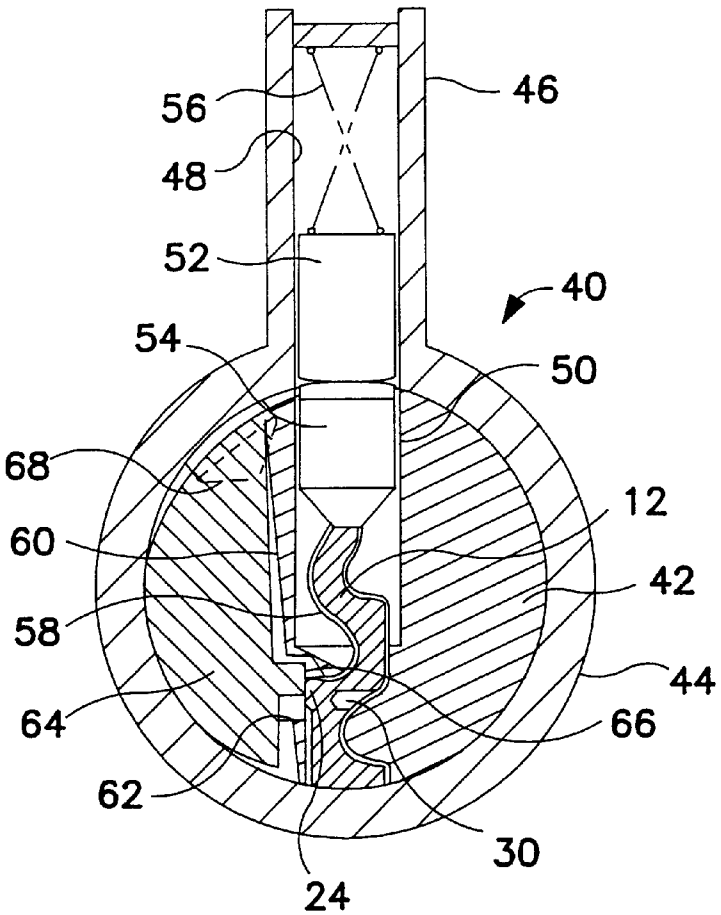
FIG. 2A is a cross-sectional, side elevation view of a first embodiment of a lock in accordance with the invention, the lock being depicted with an authorized key in the keyway and prior to rotation of the core relative to the shell.

A cylinder lock system, i.e., the combination of a cylinder lock and a key, in accordance with a first embodiment of the present invention is indicated generally at 40 in FIGS. 2A and 2B. Lock 40, as is conventional, comprises a core 42 which may be rotated, about an axis of rotation, relative to a shell 44. In the disclosed embodiment, shell 44 includes an extension or bible 46. A single linear array of pin chambers, such as chamber 48, are provided in bible 46. The pin chambers 48, with the lock in the locked state, are in axial registration with pin chambers 50 in core 42. Pin tumbler stacks, which in the embodiment being described comprise an upper or driver pin 52 and a driven or bottom pin 54, are provided in the registered pin chambers. The pin tumbler stacks are resiliently biased radially in the direction of the axis of rotation of core 42. In the embodiment being described, this biasing is accomplished by means of compression springs, such as the spring indicated schematically at 56, which contact the outwardly disposed ends of the driver pins 52. A tail piece or cam, not shown, will be connected to the end of core 42 disposed oppositely with respect to the end which defines the entrance to the keyway 58. The tail piece will be coupled to a latch mechanism or the like so that the lock system may be employed to selectively prevent and permit access to a space on one side of a door on which the lock is installed.

The lock, as described above, is of conventional construction. It will thus be understood by those skilled in the art that the configuration and location of the pin chambers and pin tumbler stacks may be varied without departing from the invention. For example, there may be multiple arrays of pin chambers, angularly offset from one another, and the pin tumbler stacks may include any number of pins.

Also in accordance with conventional construction, the keyway 58 is in communication with the inwardly disposed ends of the pin chambers 50 in the core 42. Keyway 58 will also have a profile, i.e., a cross-sectional area, chosen by the lock manufacturer. As noted above in the discussion of FIG. 1, a conventional keyway includes a plurality of wards which, in part, define the keyway cross-section. In addition to milling the key blank to define a key cross-section which is complementary to the keyway cross-section, in order to permit operation of the lock, the key blade must be further "cut", i.e., bitted, to have surface irregularities which match the lock combination as determined by the location of the pin tumbler stacks and the relative lengths of the pins forming the stacks. In the least complicated arrangement, as shown in the drawings, the key will be bitted by removing material from the upper edge of the blade to produce the customary serrated edge with flats of the appropriate height positioned so as to be alignable with individual pin tumbler chambers in the core when the key is fully inserted in the keyway. Insertion of a properly bitted key into the keyway will establish contact between the upper edge of the key blade and the bottom pins and will result in movement of the pin tumbler stacks against the bias of the springs 56 so as to place the interface between the driver and bottom pin of each pin tumbler stack at the shear line between the core 42 and shell 44. When all of the pin tumbler stacks have been repositioned from the locked state, i.e., the state where one pin of each stack bridges the shear line and thus is partly located in a pin tumbler chamber of both the core and shell, rotation of the core relative to the shell is permitted, In accordance with the present invention, at the location of at least of one of the pin tumbler stacks, a circular segment is cut from core 42. This segment is primarily defined by a wall 60 which, with the exceptions to be discussed below, is continuous between two points of intersection with the shear line. In the embodiment being described, the spacing between a first side of keyway 58 and wall 60 increases from a first end of wall 60, located adjacent the bottom of the keyway, to an opposite end of wall 60 which is adjacent to the outer end of a core pin chamber 50. Thus, wall 60 defines a ramp. An opening 62 in wall 60 provides communication between the keyway 58 and the space formed by the circular segment cut-out. Opening 62 is expediently defined by a longitudinal groove having a maximum depth which exceeds the thickness of the wall separating the circular cut-out from the keyway. This groove extends through the warding of the keyway which is complementary in shape to the shelf 22 of the blade 12 of the key blank depicted in FIG. 1.

A movable plate member 64 having a shape which is similar to, but different from, the circular segment cut-out defined by wall 60 is inserted in the cut-out. Plate 64 has a first side which faces wall 60. This first side of movable plate 64 is provided with a cam follower projection 66 which extends into and through opening 62. Movable plate 64 also has a curved outer side which extends between the ends of the first side. As may be seen, this curved outer side of plate member 64, at the lower portion thereof, has approximately the same radius as core 42 whereby the plate member will move along the inner diameter of shell 44 during core rotation. However, adjacent the upper end of the wall 60, i.e., where the wall 60 is mostly widely spaced from the keyway, the curved wall of plate member 64 will be spaced from the shell inner diameter in the absence of a proper key in keyway 58. This spacing will accommodate movement of plate member 64 relative to core 42, i.e., the plate member 64 may be cammed, in response to a force delivered to cam follower projection 66, so that it essentially presents a portion of an interrupted core outer diameter. The width of the plate member 64 is, in the disclosed embodiment, less than the diameter of the pin chamber 48 in bible 46.

Core 42 is provided with a blind hole 68 which intersects the segment cut-out defined in part by wall 60. Blind hole 68 has a size and shape complementary to the lower end of a driver pin 52. Depending upon its position in the cut-out in core 42, plate member 64 either effectively bridges blind hole 68, as clearly shown in FIG. 2B, or permits driver pin 52 to engage blind hole 68. Thus, in the absence of a camming projection 24 on the blade of the key which cooperates with the lock, the plate member 64 will be displaced from the shear line and rotation of the core relative to the shell by an otherwise properly bitted key will result in the driver pin 52 entering the blind hole 68 whereupon further rotation of the core relative to the shell in either direction will be impossible and the key will be trapped in the keyway.

In the embodiment of FIG. 2, the punch which simultaneously formed the camming projection 24 and the recess 30 operated transversely with respect to the plane defined by the sides of the key blank prior to milling. Thus, the recess 30 defines an axis transverse to the plane of the keyway. The camming projection, as may be seen from FIG. 1, is effectively symmetrical about an axis which is angularly related to the axis of recess 30. Additionally, the size and shape of the recess 30 is different from the size and shape of camming projection 24.

Figure 3B:
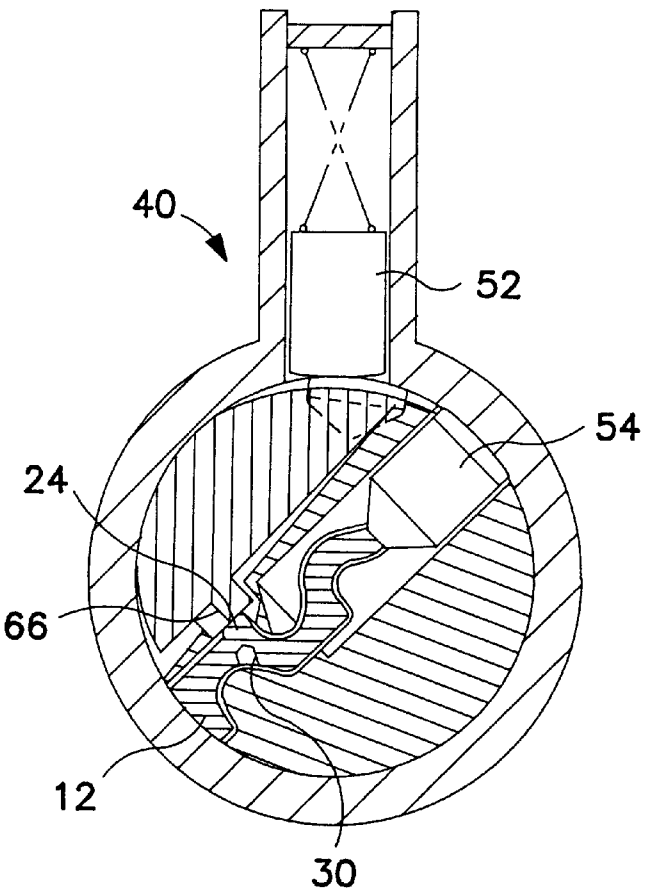
FIG. 3B is a view similar to FIG. 2B showing the lock of FIG. 3A with the,core partly rotated.
Figure 3A:
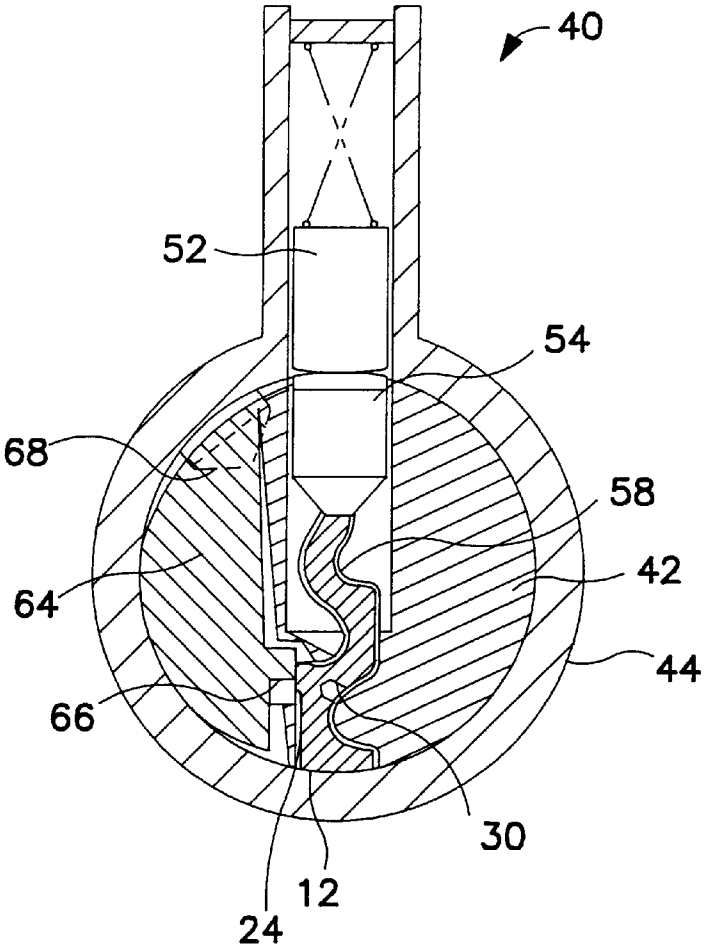
FIG. 3A is a view similar to FIG. 2A of a modified form of the first embodiment of the invention.

The embodiment of FIG. 3 differs from that of FIG. 2 only in the relative orientation of the recess 30 and camming projection 24 on the opposite sides of the key blade 12. In the FIG. 3 embodiment, while the size and shape of the recess and camming projection are different, the axes of the recess and projection are parallel and may be aligned, i.e., the forming punch will move at an acute angle relative to a plane defined by the impacted side of the key blank rather than moving generally transversely with respect to this plane as in the case of the FIG. 2 embodiment.

In the embodiment of FIG. 4, to further enhance the security afforded by the lock system, an auxiliary locking pin 80 is added to the lock. In the manner to be described below, the first or inwardly disposed end of auxiliary locking pin 80 cooperates with the recess 30 formed in the side of the key blank, i.e., the recess is sized, shaped and positioned to accept the inner end of the auxiliary locking pin, whereby the inner end of the auxiliary locking pin forms a further element of the lock code.

Figure 4B:
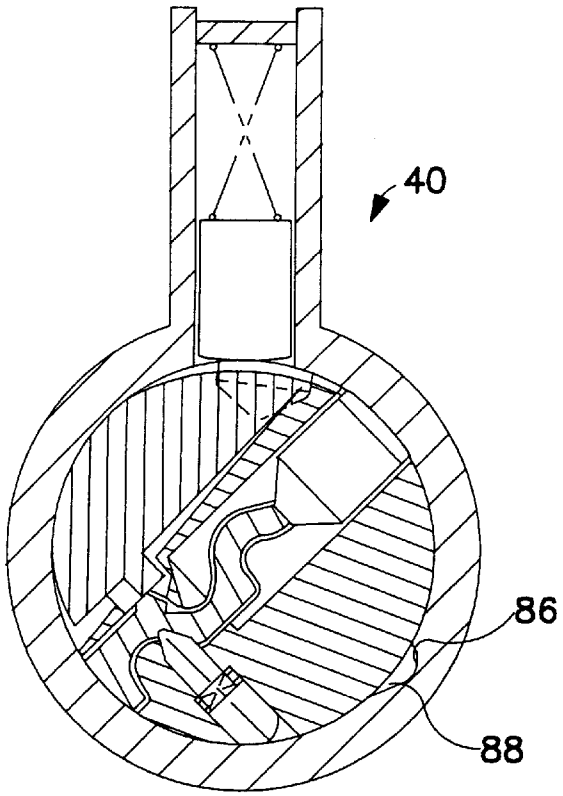
FIG. 4B is a view of the embodiment of FIG. 4A with the core partly rotated.
Figure 4A:
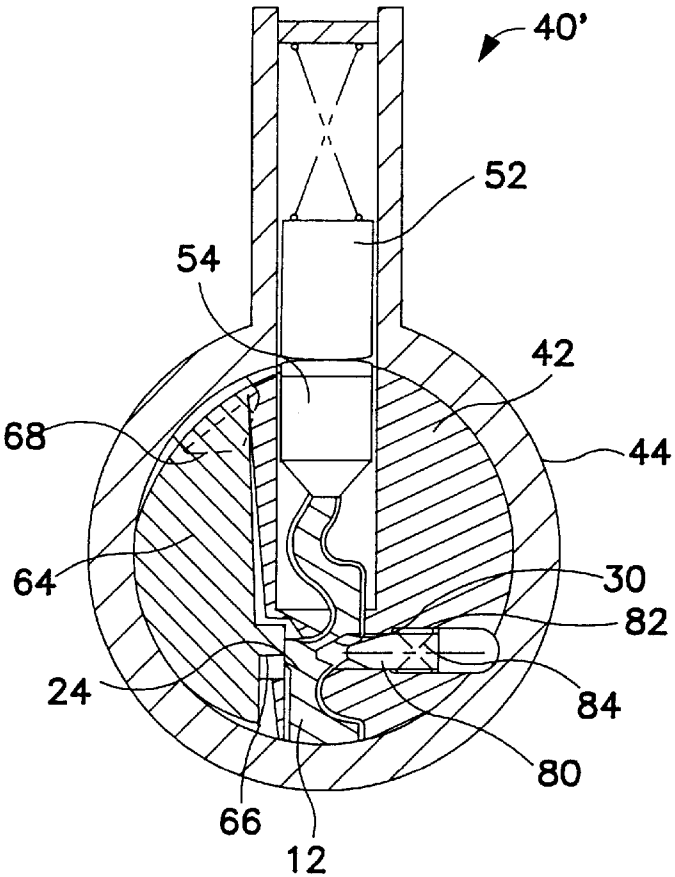
FIG. 4A is cross-sectional, side elevation view of a second embodiment of a lock in accordance with the invention, the lock being depicted with an authorized key in the keyway and prior to rotation of the core relative to the shell.

To further describe the embodiment of FIG. 4, auxiliary locking pin 80 has an axis and is disposed for reciprocal movement in pin chamber 82 provided in core 42. Chamber 82 communicates, at a first end, with keyway 58 and, at its opposite end, with the circumference of core 42. Chamber 82 has an axis which, in the embodiment being described, is oriented transversely with respect to the plane of the keyway, i.e., a plane defined by the axes of the pin tumbler stacks. Chamber 82 also has two portions of different internal diameter and thus defines a shoulder against which a first end of a biasing spring 84 is seated. The opposite end of biasing spring 84 contacts a shoulder on pin 80, this shoulder being defined by the junction of two different diameter portions of the auxiliary locking pin. Spring 84 thus urges pin 80 in the direction of shell 44. Shell 44 is provided with a recess 86 (FIG. 4B) which receives the outwardly disposed end of auxiliary locking pin 80. With the cylinder lock in the locked state, the outwardly disposed end of auxiliary locking pin 80 will be disposed in recess 86 as, for example, shown in FIG. 4A, i.e., auxiliary locking pin 80 will extend across the shear line. Accordingly, auxiliary locking pin 80 will cooperate with the pin tumbler stacks to prevent rotation of core 42 relative to shell 44 in the absence of an authorized and properly bitted key in keyway 58. The opposite, inwardly disposed end of auxiliary locking pin 80 will normally, i.e., when the lock is in the locked state, be substantially flush with the side of keyway 58 which is in communication with chamber 82.

The outwardly disposed first end of auxiliary locking pin 80 and a portion 88 of the wall which defines recess 86, i.e., the wall portion which extends from the maximum depth of the recess in the direction of core rotation to the point of merger with the inner diameter of shell 44, cooperate respectively in the manner of a cam follower and cam surface. Thus, when rotation of core 42 relative to shell 44 is enabled by a key which is properly bitted on the edge and has a properly sized, shaped and positioned camming projection 24, rotational force imparted to core 42 by the key will cause the cam follower outer end of auxiliary locking pin 80 to ride over the cooperating cam surface 88 of recess 86 and the resulting camming action will drive the auxiliary locking pin 80 axially inwardly toward the keyway. Such axially inward motion, obviously, can occur only if a space having a size, shape and location adapted to accept the second inner end of pin 80 is present.

To summarize, in the FIG. 4 embodiment, the forming punch which simultaneously produces the camming projection 24 and the recess in the opposite side of the key blade desirably will be shaped so as to substantially duplicate the shape of the second or inwardly disposed end of the auxiliary locking pin 80. Thus, the punch and cooperating backup die will simultaneously form two "bits" which meet the lock code, i.e., the camming projection and recess. As described above, in the FIG. 4 embodiment, geometrical parameters of the camming projection and recess, if security is maximized, will differ. The recess and camming projection need not, as shown in FIG. 4, be axially aligned or in complete registration with one another.

While preferred embodiments have shown and described, various modifications and substitutions may be made thereto without departing from the spirit and scope of the invention. Accordingly, it is to be understood that the present invention has been described by way of illustration and not limitation.

What is claimed is:

1. A key blank for a key intended for use in cooperation with a cylinder lock having a core which is rotatable about an axis, the core of the lock including a keyway which extends inwardly from a first end of the core, the keyway having a pair of opposite sides which define a keyway cross-sectional profile when viewed in a direction transverse to the axis of rotation of the core, the core also defining a cut-out which extends to the keyway through one of the sides of the keyway in a region displaced from the first end of the core, the cylinder lock further having a plate moveably mounted within the cut-out, the plate having a cam follower projection which extends into the keyway intermediate the ends thereof, said key blank being formed from flat metal stock having first and second substantially parallel opposed side surfaces which respectively define first and second planes, said key blank comprising:

a bow;

a blade longitudinally extending from said bow into blade tip, said blade having first and second side faces and a pair of oppositely disposed and spaced edges which interconnect said side faces, the distance between said oppositely disposed edges being much greater than th e distance between said side faces, said first and second side faces each having longitudinally extending irregularities which in part define a blade cross-section whereby said blade may be longitudinally inserted into the keyway of the cooperating cylinder lock, said irregularities being provided in said first and second side faces by machining the opposed parallel surfaces of the flat metal stock to remove metal therefrom;

at least one three dimensional camming projection extending outwardly from said blade first side face beyond the first of said planes, said camming projection having preselected geometric parameters and defining an axis which intersects said first plane at an angle, said camming projection being longitudinally displaced from said bow and said blade tip and being positioned between said blade edges whereby said camming projection is adapted to intercept the cut-out in the side of the keyway of the cooperating cylinder lock, the surface of said camming projection which faces said blade tip being adapted to drivingly engage the cam follower which extends into the keyway of the cooperating cylinder lock from a first side thereof whereby the cam follower projection of the moveable plate of the cooperating cylinder lock may be caused to move outwardly with respect to the keyway of the cooperating cylinder lock in response to longitudinal insertion of said blade into the lock keyway; and a three dimensional recess in said blade second side face, said recess having an axis and geometric parameters which correspond to the geometric parameters of said camming projection, said recess extending generally toward said blade first side face and being at least in partial registration with said camming projection, at least one of said geometric parameters of said recess being different from the corresponding parameter of said camming projection whereby said recess is not complementary to said camming projection.

2. The key blank of claim 1, wherein said one parameter comprises the angle of intersection of said axes with said planes.

3. The key blank of claim 2, wherein at least one of said longitudinally extending irregularities defines a surface which intersects said first plane at an angle, and wherein said camming projection is located on and extends from said angled surface.

4. The key blank of claim 1, wherein at least one of said longitudinally extending irregularities defines a surface which intersects said first plane at an angle, and wherein said camming projection is located on and extends from said angled surface.

5. The key blank of claim 1, wherein said one parameter comprises the shapes of said projection and recess.

6. The key blank of claim 5, wherein at least one of said longitudinally extending irregularities defines a surface which intersects said first plane at an angle, and wherein said camming projection is located on and extends from said angled surface.

7. The key blank of claim 1, wherein the cooperating cylinder lock additionally includes a shell within which the core rotates, the shell having an inner diameter and the bottom of the keyway extending to the shell whereby a first of said edges of said blade is adapted to contact the shell inner diameter during rotation of the lock core, and wherein:

said cramming projection being located in a region of said blade which is less than one half of the distance between said spaced blade edges and on the same side of the axis of core rotation as said blade first edge.

8. The key blank of claim 7, wherein the cooperating cylinder lock includes an auxiliary locking pin having a first end which contacts the shell inner diameter, the auxiliary locking pin being located in a bore which extends through the core to the keyway, the auxiliary locking pin further having a shaped second end, the auxiliary locking pin normally being resiliently biased in the direction of withdrawal of the shaped second end thereof from the keyway, and wherein:

said geometric parameters of said recess being selected whereby said recess is adapted to receive the shaped second end of the auxiliary locking pin of the cooperating lock.

9. The key blank of claim 1, wherein the cooperating cylinder lock additionally includes a shell within which the core rotates, the shell having an inner diameter and the bottom of the keyway extending to the shell whereby a first of said edge of said blade is adapted to contact the shell inner diameter during rotation of the lock core, and wherein the cylinder lock further includes an auxiliary locking pin having a first end which contacts the shell inner diameter, the auxiliary locking pin being located in a bore which extends through the core to the keyway, the auxiliary locking pin having a shaped second end, the auxiliary locking pin normally being resiliently biased in the direction of withdrawal of the shaped second end thereof from the keyway, and wherein:

said geometric parameters of said recess being selected whereby said recess is adapted to receive the shaped second end of the auxiliary locking pin.

10. The key blank of claim 9, wherein at least one of said longitudinally extending irregularities defines a surface which intersects said first plane at an angle, and wherein said camming projection is located on and extends from said angled surface.

11. The key blank of claim 9, wherein said one parameter comprises the shapes of said projection and recess.

12. The key blank of claim 9, wherein said one parameter comprises the angle of intersection of said axes with said planes.

13. The key blank of claim 12, wherein at least one of said longitudinally extending irregularities defines a surface which intersects said first plane at an angle, and wherein said camming projection is located on and extends from said angled surface.

14. The key blank of claim 13, wherein said one parameter comprises the shapes of said projection and recess.

* * * * *